United States Patent [19]

Seilhan

[11] Patent Number: 4,801,277

[45] Date of Patent: Jan. 31, 1989

[54] UNDERWATER ELECTRICAL CONNECTOR WITH KEYED INSERT SLEEVE

[75] Inventor: Denton S. Seilhan, San Diego, Calif.

[73] Assignee: Brantner & Associates, Inc., El Cajon, Calif.

[21] Appl. No.: 56,756

[22] Filed: Jun. 1, 1987

[51] Int. Cl.[4] ..... H01R 13/64

[52] U.S. Cl. ..... 439/680; 439/597

[58] Field of Search ..... 439/597, 598, 589, 680, 439/292, 286, 294, 310, 311, 316, 349, 370, 372, 672, 674, 592

[56] References Cited

U.S. PATENT DOCUMENTS

| | | | |
|---|---|---|---|
| 1,975,467 | 2/1955 | Livingston | 339/90 R |
| 2,701,348 | 2/1955 | Horn | 339/90 R |
| 3,008,116 | 11/1961 | Blanchenot | 339/90 R |
| 3,182,280 | 5/1965 | Daut et al. | 339/90 R |
| 3,351,886 | 11/1967 | Zimmerman, Jr. | 439/680 |
| 4,235,498 | 11/1980 | Snyder | 339/90 R |
| 4,264,116 | 4/1981 | Gliha, Jr. | 339/89 M |
| 4,531,802 | 7/1985 | Tomsa | 339/90 R |
| 4,647,127 | 3/1987 | Weingartner | 439/597 |

*Primary Examiner*—Gil Weidenfeld
*Assistant Examiner*—Paula A. Austin
*Attorney, Agent, or Firm*—Brown, Martin, Haller & Meador

[57] ABSTRACT

An underwater electrical connector comprises a pair of mating plug and socket connector shells each containing a contact carrying insert body. When the shells are connected together, contact pins projecting from the front face of one of the insert bodies engage in corresponding contact sockets on the front face of the other insert body. The connector shells have an interengageable key and keyway formation for maintaining correct orientation as they are secured together. Each insert body has a keyed engagement with its respective shell as it is inserted. One of the insert bodies has a rearwardly projecting sleeve which engages in a corresponding rearwardly projecting sleeve on the respective connector shell as it is inserted. The shell sleeve has an axial through slot extending from its free end, and the insert body sleeve has a corresponding outwardly projecting key for engagement in the through slot.

9 Claims, 1 Drawing Sheet

UNDERWATER ELECTRICAL CONNECTOR WITH KEYED INSERT SLEEVE

BACKGROUND OF THE INVENTION

The present invention relates generally to electrical connectors, and particularly to electrical connectors suitable for underwater use.

Electrical connectors are commonly used for connecting the wires of one cable to the corresponding wires of a similar cable. Typically, the connector comprises plug and socket type connector shells each containing an insert body carrying a plurality of electrical contacts. One of the insert bodies will have a series of projecting electrical pin contacts, while the other insert body will have corresponding pin receiving socket contacts. When the mating connector shells are secured together, the contact pins will be engaged in the corresponding sockets. The cable wires are soldered to contact or solder projections at the rear end of each of the insert bodies. The insert bodies are provided with any number of contact pins or sockets, according to the type of electrical cable to be connected, and they are releasably mounted in the respective connector shells so that different contact carrying inserts can be mounted in the same connector shell according to the particular connection to be made.

One problem with such connectors is maintaining the insert bodies in the correct relative angular orientation so that the pins will slide smoothly into the sockets as the shells are connected together. Any misalignment will result in damage to the pins during the mating procedure, and may result in an improper electrical connection which could result in damage to electrical equipment connected via the connector.

Thus electrical connectors of this type are generally provided with key arrangements for maintaining accurate relative angular orientation between the respective parts as they are connected together. U.S. Pat. No. 4,235,498 of Snyder, for example, shows a plug and socket type connector in which the socket has internal keyways for engagement with corresponding projecting keys on the outer surface of the plug as they are connected together. Where the insert bodies are releasably mounted in the plug and socket shells, they must also be provided with a keying arrangement to ensure accurate orientation. Thus it is known to provide internal keyways in the plug and socket shells for engagement with corresponding projecting keys on the insert bodies as they are inserted. One problem with this is that since the keys and keyways are internal, and thus within the shell as the insert body is inserted, it is difficult to accurately align the key and keyway. The key must first be visually aligned before inserting the insert body, at which point it can no longer be seen.

This alignment is even more difficult in cases where the insert body is inserted through the rear end of the connector shell, so that the connected cable is in the way of any clear view of the insert key as it is inserted. Although insert bodies are frequently arranged to be insertable through the front end of the respective connector shell, rear end insertion is used in some designs, particularly in miniature underwater connectors, making alignment difficult. In some cases, the key will be sheared off if not correctly aligned. Thus, if the key and keyway are misaligned, the key may be damaged if the insert body is forced in and the insert contacts may not be in the correct orientation.

SUMMARY OF THE INVENTION

It is an object of the present invention to provide an improved keying arrangement for inserting a contact insert body into a connector shell.

According to the present invention, an electrical connector is provided which comprises a pair of mating connector shells, one of the shells comprising a socket and the other shell comprising a plug for mating engagement in the socket, and a pair of insert bodies for insertion in respective ones of the connector shells, one of the insert bodies having a series of contact pins projecting from a front face and the other insert body having corresponding contact sockets in a front face for receiving the contact pins when the plug and socket shells are connected together. Corresponding key and keyway formations are provided on the connector shells to maintain them in a predetermined relative angular orientation as they are secured together. Each of the insert bodies and corresponding connector shell also have mateable key and keyway formations for ensuring that the insert body is maintained in a predetermined relative orientation to the corresponding connector shell as it is inserted into the shell. According to the present invention, the key and keyway formation of at least one insert body and corresponding connector shell are provided on rearwardly projecting sleeves on the insert body and shell. The shell sleeve has at least one through slot extending axially from its free end comprising the keyway, and the insert body sleeve has a corresponding projection comprising a key for engagement in the slot as the insert body is inserted through the rear end of the shell sleeve.

With this arrangement, the insert body key is visible at all times during positioning of the insert body in the connector shell. Thus it is easy to maintain the insert body in the correct orientation. The insert body is designed to be inserted through the rear end of the connector shell, and will have a rear face provided with solder projections connected to each of the contacts on its front face, for connection to leads of a cable to be connected. The key carrying sleeve projects rearwardly from this rear face, and is preferably split into two halves with gaps between the half sections to allow access to the solder projections from the sides of the sleeve as the cable wires are being connected.

The other insert body and connecting shell may be provided with similar or alternative keying arrangements, depending on the shell design. Where the insert body is designed to be inserted from the front end of the connector shell, it may have a simple key for engagement with an internal recess on the connector shell in the standard fashion, although the key and keyway width dimensions may be increased to reduce the risk of forcing and shearing off of the key.

BRIEF DESCRIPTION OF THE DRAWINGS

The present invention will be better understood from the following detailed description of a preferred embodiment of the invention, in which like reference numerals refer to like parts, and in which.

DESCRIPTION OF THE PREFERRED EMBODIMENT

Figure 1:
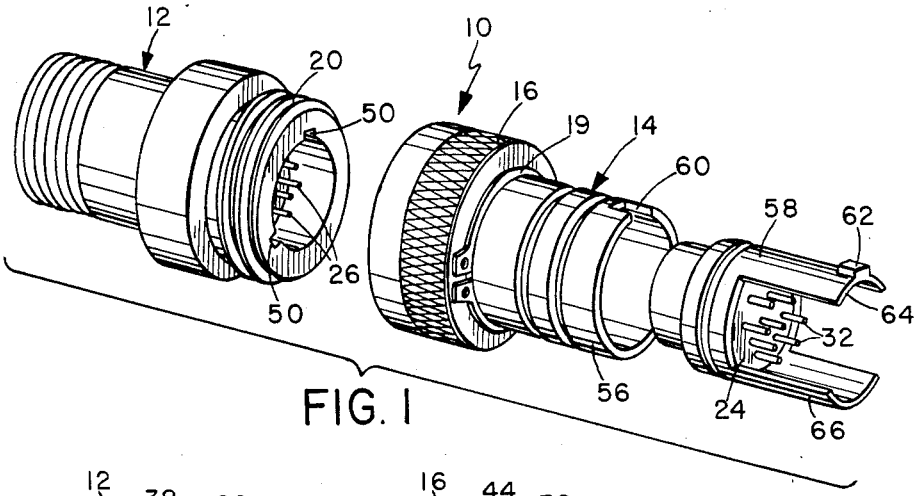
FIG. 1 is a perspective view of a plug and socket connector incorporating the alignment key structure according to a preferred embodiment of the present invention.
Figure 2:
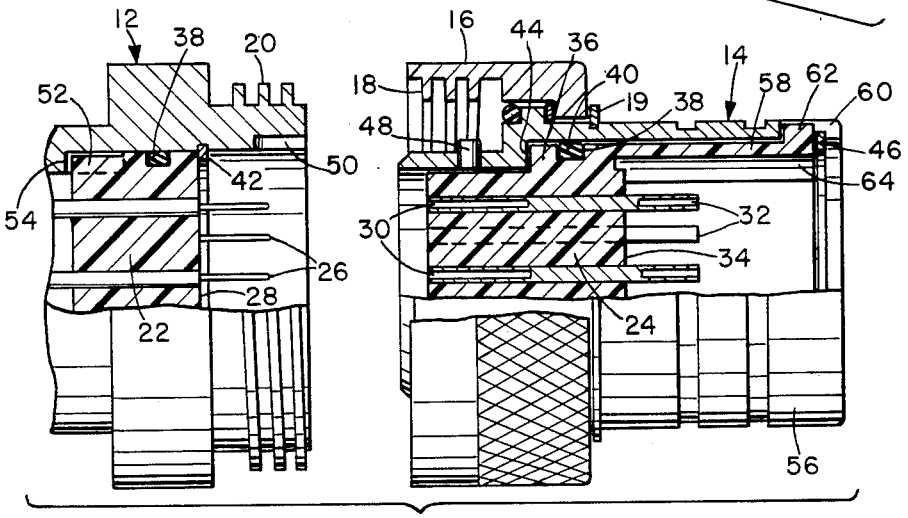
FIG. 2 is a side elevation view, partly cut away, of the plug and socket.
Figure 3:
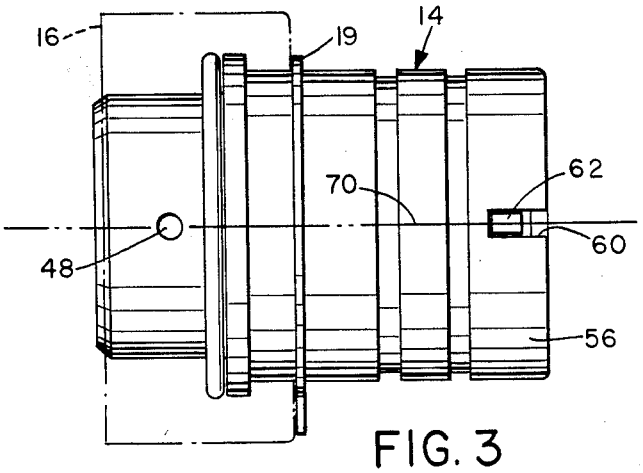
FIG. 3 is a top plan view of the plug shell unit, showing the alignment key configuration.

FIGS. 1 to 3 of the drawings show an electrical connector 10 of the plug and socket type incorporating an alignment key configuration according to a preferred embodiment of the present invention. The connector is preferably of the underwater type which is arranged to be sealed against ingress of water into the electrical contacts. However, the alignment key may also be used in other types of electrical connectors.

As best shown in FIGS. 1 and 2, the electrical connector comprises a pair of connector shells 12, 14, one of the shells 12 comprising a socket and the other shell 14 comprising a plug for mating engagement in the socket. A coupling or engaging nut 16 having internal screw threads 18 is retained on the plug shell 14 by retaining ring 19 and engages external screw threads 20 on the front end of the socket to releasably secure the plug to the socket in a standard fashion.

Each connector shell contains an insert body 22, 24 of insulating material. One of the insert bodies 22 has a series of contact pins 26 projecting from its front face 28, while the other insert body 24 has a corresponding series of contact sockets 30 on its front face for receiving the contact pins when the plug is mated with the socket. As seen in FIG. 2, the contact sockets are electrically connected with solder or contact projections 32 projecting from the rear face 34 of the insert body 24. The contact pins will be connected to similar solder projections at the rear face of insert body 22 (not shown). The solder connections will be soldered to wires at the cables to be connected via the connector, which may be cable enclosed wires or other wire leads.

In practice a plurality of different insert bodies are provided which will fit in the same connector shells, each pair of insert bodies having different numbers and arrangements of electrical contacts so that the electrical connector can be used to connect various types of electrical cables either to other cable or to connector wires by selection of inserts having the appropriate number of contacts. In miniature underwater connectors the insert bodies may have a very high contact density, making accurate alignment of the contact pins and sockets critical. Although in FIGS. 1 and 2 the pin carrying insert is mounted in the socket while the socket carrying insert is mounted in the plug, the arrangement may be reversed with insert body 22 carrying contact sockets while insert body 24 carries corresponding contact pins. In the drawings the socket shell 12 is shown as a through bulkhead connector. However, the plug and socket shells may be designed as cable to cable connectors, through bulkhead connectors or flange connectors.

Each of the insert bodies has an annular rim or shoulder 36 having a groove 38 for receiving an 0.,ring 40 for sealing against the inner surface of the respective connector shell when the insert body is fully inserted. Socket insert body 22 is preferably inserted through the forward, plug engaging end of socket 12 and is retained in position by locking ring 42. Plug insert body 24 is preferably inserted through the rear end of plug shell 14 until shoulder 36 is stopped by engagement with shoulder 44 of plug shell 14. The insert body 24 may also be retained in the shell 14 by means of a suitable locking ring or split washer 46. Thus in the connector arrangement shown, insert body 22 is designed to be inserted through the front end of shell 12 while insert body 24 is designed to be inserted through the rear end of shell 14. The plug shell design with internal shoulder 44 is particularly intended for use as part of a miniature underwater connector, and this design requires insertion of body 24 from the rear.

It is critical that the contact pins and sockets of the two connector parts are accurately aligned with one another on connection. Any misalignment could result in damage to the pins and improper electrical connections. With insert bodies having many different possible contact numbers and configurations, some of which have very high contact density, even a slight misalignment can cause problems. Thus keying arrangements are provided between the various parts to ensure that the insert bodies are in a predetermined relative angular orientation on connection. As shown in FIG. 2, the plug shell 14 has one or more projecting keys or pins 48 which must be aligned with corresponding keyways or slots 50(see FIG. 1) on the inner surface of socket shell 12 as the plug is inserted into the socket. This ensures that the plug and socket shells are in a predetermined relative orientation when connected. In FIGS. 1 and 2 only one key pin 48 for engaging in one of the slots 50 is visible, but a corresponding key pin will be provided for alignment with the other slot 50 visible in FIG. 1.

The insert bodies must also be maintained in the correct orientation as they are secured in the respective connector shells. In prior art arrangement the insert bodies are commonly provided with a small projecting key on their outer surfaces for engagement in an internal recess in the connector shell as the insert body is inserted. However, this internal keying arrangement is not visible once the body is partially inserted, so that the key must be aligned by eye prior to insertion. This type of arrangement can result in misalignment of the internal key and socket, with potential shearing off of the key if it is misaligned, possibly resulting in damage to the pin contacts and improper electrical connection. Where the insert body is inserted through the front end of the connector shell, as is the case with socket insert 22 in the arrangement shown in the drawings, the internal keying arrangement is less of a problem since the key can be seen up to the point it is inserted and the insert body does not have to be inserted very far into shell 12. As shown in FIG. 2, insert 22 has a projecting key 52 at its inner end (see FIG. 2) which engages in a corresponding internal slot or keyway 54 in the socket shell if the parts are in the correct relative orientation as the insert body 22 is inserted through the front end of the socket shell 12. Since the key and keyway on the insert and socket shell are internal, they will not be easily visible once the insert body is partially inserted into the shell. However, the key and keyway 52, 54 are made larger than is standard in internal insert body keying arrangements of this type. Thus key and keyway 52, 54 are preferably at least 3 times wider than in previous insert body key arrangements.

A similar internal key and keyway engagement on the plug shell and insert 24 would be completely shielded and invisible once the insert 24 was partially inserted, making accurate orientation extremely difficult, particularly in view of the rear end insertion of insert body 24 and the connected cable at the rear end of body 24 which further impedes accurate orientation. As shown in the drawings, both the plug shell and the insert 24 are provided with rearwardly extending sleeves 56, 58, respectively. The insert sleeve 58 fits within the plug sleeve 56 when the insert is advanced into the plug shell from the rear as viewed in FIG. 1. The plug shell has a through slot or keyway 60 extending axially from its rear end, while the insert sleeve has a projecting rib or key 62 at its rear end, as seen in the drawings. The insert sleeve 58 is preferably split into two parts or tongues 64, 66 with gaps between the tongues for easy access to the solder points 32, as best shown in FIG. 1. Alternatively, a single split or gap for access to these points could be provided. Although only one key and keyway is shown on the plug and insert in the drawings, in practice an additional slot and a corresponding key on tongue 66 could be provided if desired.

The plug insert 24 can easily be maintained in the correct orientation when inserted into the plug shell 14 with the keying arrangement shown in the drawings. The externally visible key 62 is simply aligned with the corresponding external slot 60 on line 70 as viewed in FIG. 3, and the alignment can easily be maintained during insertion since the key and keyway will be visible at all times. When the insert has been fully inserted up to shoulder 44, the locking or retaining ring 46 is positioned as shown in FIG. 2 to secure the insert in place. Although in the embodiment shown in the drawings the socket insert is shown with an internal key for engagement with an internal keyway in the socket shell, a similar keying arrangement to that on the plug shell and insert may be provided between the socket shell and insert. Thus insert 22 may be provided with a rearwardly projecting split sleeve with one or more outwardly projecting keys or pins on the sleeve, while the rear end of socket shell 12 could be provided with one or more axially extending through slots for receiving the key or keys on the insert sleeve. However this is not normally necessary if the insert body is inserted from the front end of the shell, since insertion in this direction is much easier in practice and the connected cable does not impede viewing of the key as it is inserted into the shell.

Prior to connection of the appropriate insert body in the connector shells, the cables to be connected together are first joined to the respective insert bodies. Insert bodies having the required number of contacts are selected, and the ends of the cable or other wires are soldered to the appropriate solder points 32 at the rear end of each insert body. In the case of the plug insert 24, soldering is done via the access gaps in the sleeve. The insert bodies are then orientated relative to the appropriate shells and inserted so that keying engagement between the parts is achieved. Once each insert body has been accurately inserted, it is secured in place by means of a securing ring or the like as shown in the drawings.

The reduced diameter front end of the plug shell is then inserted axially into the front end of socket shell 12 so that its key or keys are aligned with the keyways at the front end of the shell 12. The contact pins on insert 22 will slide into the appropriate aligned contact sockets on insert 24 as the plug shell is inserted. As the plug shell is inserted, coupling nut 16 is tightened by rotating it on shell 12 to lock the parts together. In the case of an underwater connection, appropriate sealing boots surround each external connector shell and the cable connected to that shell, as is known in the field. These may be either field installed or molded in place prior to installation.

The connector shells may be provided in various sizes to allow connection of a wide range of electrical cable types. Each size of shell will be associated with a range of insert bodies having different numbers and configurations of contact pins and sockets, according to the various wire configurations in cables to be connected by those shells. In practice insert bodies may have any number of contacts between 2 and several hundred. Thus it can be seen that accurate orientation of the inserts with the respective shells, and of the shells with each other on connection, is extremely critical, particularly when the contact density is very high, as is sometimes the case in miniature underwater connectors. The improved externally visible keying arrangement of this invention is particularly intended for use in miniature underwater connector shells which have an internal design requiring insertion of the contact carrying insert body from the rear of the shell, although it may also be used to advantage in other connector shell designs. Thus the keying arrangement shown is particularly suitable for miniature underwater connectors having an outer diameter between about one inch to about three inches, where the connector shell configuration requires rear end insertion of the contact body. In such underwater connector designs, a plurality of different insert bodies having different contact numbers and configurations may be provided for fitting into each connector shell. Up to 40 or more different contact configurations may be provided in practice for such connectors. Thus accurate contact orientation is extremely critical.

The keying arrangement between the plug shell and insert described above avoids the problems of improper orientation which can occur when the key engagement between the shell and insert is completely internal, and thus invisible as soon as the insert is partially advanced into the corresponding connector shell. Thus the improved keying arrangement of this invention makes it easier to maintain accurate orientation between the insert and connector shell, and substantially reduces the risk of improper alignment resulting in damage to the parts or to the connector.

Although a preferred embodiment of the invention has been described above by way of example only, it will be understood by those skilled in the field that modifications may be made to the disclosed embodiment without departing from the scope of the invention, which is defined by the appended claims.

I claim:

1. An electrical connector, comprising:

a pair of mating connector shells, one of the shells comprising a socket and the other shell comprising a plug for mating engagement in the socket;

a first insert body for engagement in one of the connector shells and a second insert body for engagement in the other connector shell, one of the insert bodies having contact pins projecting from its front face and the other insert body having corresponding contact sockets in its front face for slidably receiving the contact pins when the plug and socket shells are connected together;

one of the connector shells having at least one keyway and the other connector shell having a corresponding key for engaging in the keyway as the parts are connected together to maintain a predetermined relative angular orientation between the connected shells;

each of the insert bodies and corresponding connector shell having interengageable keying means for maintaining a predetermined relative angular orientation .between the insert body and respective connector shell as the insert body is engaged in the shell;

the keying means of at least one insert body and corresponding connector shell comprising a rearwardly projecting sleeve on the connector shell for receiving the insert body, the sleeve having at least one through slot extending axially from its rear end along part of its length, and a sleeve projecting rearwardly from the rear face of the insert body having at least one outwardly projecting key for engagement in the slot in the connector shell sleeve as the insert body is inserted into the connector shell.

2. The connector as claimed in claim 1, wherein at least one of the connector shells has an internal configuration requiring insertion of the corresponding insert body from the rear end of the shell, and the rearwardly projecting sleeve having a through slot is provided on said one connector shell.

3. The connector as claimed in claim 2, wherein said one connector shell is the plug part of the connector.

4. The connector as claimed in claim 1, wherein each insert body has a series of connector projections projecting from its rear face corresponding to the contacts on the front face of the insert body for connection with electrical cable wires, the contact pins and contact sockets on the insert bodies being electrically connected to the connector projections, and the rearwardly projecting sleeve on at least one of the insert bodies and surrounding the connector projections.

5. The connector as claimed in claim 4, wherein the sleeve on the insert body has at least one split extending along its length to allow access to the connector projections from the side of the sleeve.

6. The connector as claimed in claim 5, wherein the insert body sleeve is split into two halves with two gaps separating the two halves.

7. A miniature underwater electrical connector, comprising:

a pair of mating connector shells, one of the shells comprising a socket having a front end and the other shell comprising a plug having a front end for mating engagement in the socket;

a first insert body for engagement in one of the connector shells and a second insert body for engagement in the other connector shell, one of the insert bodies having a front face with contact pins projecting from its front face and the other insert body having a front face with corresponding contact sockets on its front face for slidably receiving the contact pins when the plug and socket shells are connected together;

a first one of the connector shells having a reduced internal diameter at its forward end and a shoulder comprising a stop for abutment with the corresponding insert body as it is inserted through the rear end of the connector shell;

one of the connector shells having at least one keyway and the other connector shell having a corresponding key for engagement in the keyway as the parts are connected together to maintain a predetermined relative angular orientation between the connected shells;

releasable locking means for releasably securing the plug and socket together;

each of the insert bodies and corresponding connector shell having interengageable keying means for maintaining a predetermined relative angular orientation between the insert body and respective connector shell as the insert body is engaged in the shell;

the keying means of the first connector shell and corresponding insert body comprising a rearwardly projecting sleeve on the connector shell for receiving the insert body as it is inserted through the rear end of the shell, the sleeve having at least one through slot extending axially from its rear end comprising a keyway, and a sleeve projecting rearwardly from the rear face of the insert body having at least one outwardly projecting key for engagement in the keyway in the connector shell sleeve as the insert body is inserted through the rear end of the connector shell.

8. The connector as claimed in claim 7, wherein a plurality of different insert bodies having different contact configurations are provided for selectively fitting into each connector shell, and the connector shell outer diameter is in the range between about one inch to about three inches.

9. An electrical connector comprising:

a pair of mating connector shells, one of the shells comprising a socket and the other shell comprising a plug for mating engagement in the socket;

a first insert body for engagement in one of the connector shells and a second insert body for engagement in the other connector shell, one of the insert bodies having contact pins projecting from its front face and the other insert body having corresponding contact sockets in its front face for slidably receiving the contact pins when the plug and socket shells are connected together;

one of the connector shells having at least one keyway and the other connector shell having a corresponding key for engaging in the keyway as the part are connected together to maintain a predetermined relative angular orientation between the connected shells;

each of the insert bodies and corresponding connector shell having interengageable keying means for maintaining a predetermined relative angular orientation between the insert body and respective connector shell as the insert body is engaged in the shell;

the keying means of at least one insert body and corresponding connector shell comprising a rearwardly projecting sleeve on the connector shell for receiving the insert body, the sleeve having at least one through slot extending axially from its rear end along part of its length, and a sleeve projecting rearwardly from the rear face of the insert body having at least one outwardly projecting key for engagement in the slot in the connector shell sleeve as the insert body is inserted into the connector shell; and each insert body having a series of connector projections projecting from its rear face corresponding to the contacts on the front face of the insert body for connection with electrical cable wires, the contact pins and contact sockets on the insert bodies being electrically connected to the connector projections, and the rearwardly projecting sleeve on at least one of the insert bodies surrounding the connector projections on that insert body.

* * * * *